US011724158B2

(12) United States Patent
Yu

(10) Patent No.: US 11,724,158 B2
(45) Date of Patent: Aug. 15, 2023

(54) WATER GOGGLES

(71) Applicant: Shenzhen Reanson Products Co., LTD, Guangdong (CN)

(72) Inventor: Dongqing Yu, Guangdong (CN)

(73) Assignee: Shenzhen Reanson Products Co., LTD, Shenzhen (CN)

( * ) Notice: Subject to any disclaimer, the term of this patent is extended or adjusted under 35 U.S.C. 154(b) by 171 days.

(21) Appl. No.: 17/361,298

(22) Filed: Jun. 28, 2021

(65) Prior Publication Data

US 2021/0322832 A1 Oct. 21, 2021

Related U.S. Application Data

(63) Continuation of application No. PCT/CN2019/128222, filed on Dec. 25, 2019.

(30) Foreign Application Priority Data

Jan. 4, 2019 (CN) ..... 201910007459.7

(51) Int. Cl.
*A63B 33/00* (2006.01)
*B63C 11/12* (2006.01)

(52) U.S. Cl.
CPC ..... *A63B 33/002* (2013.01); *B63C 11/12* (2013.01); *B63C 2011/128* (2013.01)

(58) Field of Classification Search
CPC ..... B63C 11/12; B63C 2011/128; B63C 2011/123; B63C 2011/125; B63C 2011/126; A63B 33/002; A63B 33/004
(Continued)

(56) References Cited

U.S. PATENT DOCUMENTS 850,997 A * 4/1907 Cover ..... A61F 9/026 2/440
2,150,791 A * 3/1939 Welsh ..... A63B 33/004 2/440

(Continued)

FOREIGN PATENT DOCUMENTS

CN 2785651 Y 6/2006
CN 104474673 A 4/2015

(Continued)

OTHER PUBLICATIONS

International Search Report of PCT Patent Application No. PCT/CN2019/128222 dated Mar. 27, 2020.

*Primary Examiner* — Amy Vanatta

(57) ABSTRACT

The present invention relates to water goggles, and particularly relates to water goggles having an excellent waterproofing effect, including a rim, a lens sealedly arranged on the rim, an elastic waterproofing ring sealedly arranged on an inside edge of the rim, and a head band whereof two ends are separately connected to the elastic waterproofing ring. The flexible waterproofing ring includes a first connection part connected to the rim, a support part connected to the first connection part, a left-eye contact part connected to the support part and pressed against the rim of a person's left eye, and a right-eye contact part connected to the support part and pressed against the rim of a person's right eye. The left side of the head band is connected to the left-eye contact part, and the right side of the head band is connected to the right-eye contact part.

6 Claims, 12 Drawing Sheets

(58) Field of Classification Search
USPC ..... 2/426–428, 430–431, 439, 452
See application file for complete search history.

(56) References Cited

U.S. PATENT DOCUMENTS

| | | | | | |
|---|---|---|---|---|---|
| 2,309,832 | A * | 2/1943 | Dockson | A61F 9/025 | 2/440 |
| 2,430,881 | A * | 11/1947 | Lehmberg | B63C 11/12 | 2/437 |
| 2,799,020 | A * | 7/1957 | Currie | B63C 11/12 | D24/110.2 |
| 3,010,108 | A * | 11/1961 | Sachs | B63C 11/12 | 2/430 |
| 3,051,957 | A * | 9/1962 | Chan | G02C 3/02 | 2/444 |
| 3,143,739 | A * | 8/1964 | Beuchat | B63C 11/12 | D24/110.2 |
| 3,606,648 | A * | 9/1971 | Schuler | B63C 11/12 | 2/452 |
| 5,216,759 | A * | 6/1993 | Hewitt | A61F 9/02 | 2/431 |
| 5,572,989 | A * | 11/1996 | Lutz | B63C 11/12 | 128/207.14 |
| 5,657,493 | A * | 8/1997 | Ferrero | B63C 11/12 | 2/452 |
| 2003/0208835 | A1* | 11/2003 | Pan | B63C 11/12 | 2/428 |
| 2006/0162056 | A1* | 7/2006 | Sato | B63C 11/12 | 2/452 |
| 2009/0165191 | A1* | 7/2009 | Kuroda | B63C 11/12 | 2/443 |
| 2013/0111655 | A1* | 5/2013 | Kuroda | B63C 11/12 | 2/431 |
| 2014/0013494 | A1* | 1/2014 | Godoy | B63C 11/12 | 2/428 |
| 2018/0015990 | A1* | 1/2018 | Godoy | B63C 11/12 | |

FOREIGN PATENT DOCUMENTS

| | | | | |
|---|---|---|---|---|
| CN | 205903587 U | 1/2017 | | |
| CN | 206979981 U | 2/2018 | | |
| CN | 207323991 U | 5/2018 | | |
| CN | 209519316 U | 10/2019 | | |
| EP | 2423099 B1 * | 4/2019 | | A63B 33/002 |
| GB | 2432918 A | 6/2007 | | |

* cited by examiner

WATER GOGGLES

CROSS REFERENCE TO RELATED APPLICATIONS

The present application is a Continuation Application of PCT Application No. PCT/CN2019/128222 filed on Dec. 25, 2019, which claims priority from Chinese patent application No. 201910007459.7 filed on Jan. 4, 2019, and claims its priority. The entire disclosure of the application is incorporated herein by reference in its entirety.

FIELD OF TECHNOLOGY

The present application relates to a water goggles, in particular to water goggles with good waterproofing effect.

BACKGROUND TECHNOLOGY

Water goggles are used for observing underwater scenes, such as swimming goggles and diving goggles. In order to improve the comfort when wearing the water goggles, and at the same time prevent water leakage, most of the water goggles are equipped with an elastic waterproof ring on an inner side of the rim. Generally speaking, the elastic waterproof ring includes a left-eye contact part that fits the outer contour of the orbit of the left eye, and a right-eye contact part that fits the outer contour of the orbit of the right eye. During use, it is necessary to ensure that the left-eye contact part is closely fitted to the outer contour of the left eye, and the right-eye contact part is closely fitted to the outer contour of the right eye, in order to prevent water from entering the goggles and affecting eyes.

The left/right-eye contact part of existing water goggles can be closely fitted to the outer contour of the orbit of the left/right eye when putting on. However, during swimming or diving, the outer periphery of the left/right-eye contact part may be easily detached from the outer contour of the left/right eye (i.e., the outer periphery of the left/right-eye contact part may be flipped over), so that the left/right-eye contact part is entirely separated from the orbit of the left/right eye, causing water to enter into the water goggles, and bringing great inconvenience to the user.

SUMMARY

An objective of the present application is to provide water goggles with good waterproofing effect to overcome the above-mentioned defects in the prior art.

In order to achieve the objective, a technical proposal provided by the present application is:

water goggles including a rim, a lens fixed on the rim in a sealed manner, an elastic waterproofing ring sealed on an inner side of the rim, and a head band connected to the elastic waterproofing ring at both ends thereof. The elastic waterproofing ring includes a first connection part fixedly connected to the rim, a support part connected to the first connection part, a left-eye contact part connected to the support part and to be pressed against an outer contour of a left eye, and a right-eye contact part connected to the support part and to be pressed against an outer contour of a right eye. A left side of the head band is fixedly connected to the left-eye contact part, and a right side thereof is fixedly connected to the right-eye contact part.

In the above water goggles (mainly referring to swimming goggles and diving goggles), since the left side of the head band is fixedly connected to the left-eye contact part, and the right side thereof is fixedly connected to the right-eye contact part, the left side of the head band may apply a pulling force towards the user's head on the left-eye contact part, and the right side of the head band may apply a pulling force towards the user's head on the right-eye contact part, such that the left-eye and right-eye contact parts are closely fitted to the orbit of the left and right eyes without detaching, thereby greatly improving the waterproofing effect.

Further, the left-eye contact part is provided with a first reinforcing rib for evenly distributing the pulling force applied thereon by the left side of the head band.

Further, the right-eye contact part is provided with a second reinforcing rib for evenly distributing the pulling force applied thereon by the right side of the head band.

Further, the first reinforcing rib includes at least one of a first reinforcing rib A extending towards the first connection part from a position connected with the left side of the head band (namely, the first reinforcing rib A may be provided on the left-eye contact part only, or an inner end thereof may extend to the support part or the first connection part), a first reinforcing rib B provided along an upper edge of an outer circumference of the left-eye contact part, and a first reinforcing rib C provided along a lower edge of the outer circumference of the left-eye contact part. The first reinforcing rib A allows the pulling force applied on the left-eye contact part by the left side of the head band to be evenly distributed to the inside of the left-eye contact part; The first reinforcing rib B allows the pulling force applied on the left-eye contact part by the left side of the head band to be evenly distributed to the upper edge of the outer circumference of the left-eye contact part; and the first reinforcing rib C allows the pulling force applied on the left-eye contact part by the left side of the head band to be evenly distributed to the lower edge of the outer circumference of the left-eye contact part.

Further, the second reinforcing rib includes at least one of a second reinforcing rib A extending towards the first connection part from a position connected with the right side of the head band (namely, the second reinforcing rib A may be provided on the right-eye contact part only, or an inner end thereof may extend to the support part or the first connection part), a second reinforcing rib B provided along an upper edge of an outer circumference of the right-eye contact part, and a second reinforcing rib C provided along a lower edge of the outer circumference of the right-eye contact part. The second reinforcing rib A allows the pulling force applied on the right-eye contact part by the right side of the head band to be evenly distributed to the inside of the right-eye contact part; The second reinforcing rib B allows the pulling force applied on the right-eye contact part by the right side of the head band to be evenly distributed to the upper edge of the outer circumference of the right-eye contact part; and the second reinforcing rib C allows the pulling force applied on the right-eye contact part by the right side of the head band to be evenly distributed to the lower edge of the outer circumference of the right-eye contact part.

Further, there are multiple ways to connect the left side of the head band to the left-eye contact part and the right side of the head band to the right-eye contact part. Three connection ways are disclosed in the present application:

First, a left connection member is provided on an outer wall of the left-eye contact part, and a right connection member is provided on an outer wall of the right-eye contact part. The left side of the head band is fixedly connected to the left connection member, and the right side of the head band is fixedly connected to the right connection member.

Second, the left side of the head band is adhered to the left-eye contact part, and the right side of the head band is adhered to the right-eye contact part.

Third, the left side of the head band is formed into an integrated structure with the left-eye contact part (for example, by injection molding), and the right side of the head band is formed into an integrated structure with the right-eye contact part (for example, by injection molding).

Further, there are multiple designs for the connection between the left side of the head band and the left-eye contact part, and the right side of the head band and the right-eye contact part, such as:

a left end portion of the head band is smoothly connected to a left side of the outer circumference of the left-eye contact part, and a right end portion thereof is smoothly connected to a right side of the outer circumference of the right-eye contact part;

alternatively, the left side of the head band is connected to the outer wall of the left-eye contact part, and the right side of the head band is connected to the outer wall of the right-eye contact part.

Further, the left side of the head band is closely fitted to the outer wall of the left-eye contact part, and the right side of the head band is closely fitted to the outer wall of the right-eye contact part;

alternatively, the left end portion of the head band is connected to the outer wall of the left-eye contact part (namely, a part of the left side of the head band is located on an upper side of the left-eye contact part), and the right end portion of the head band is closely fitted to the outer wall of the right-eye contact part (namely, a part of the right side of the head band is located on an upper side of the right-eye contact part).

Further, in the water goggles in the present application, the lens and the rim form an integrated structure, and they can also be assembled so that the lens can be sealed and fixed to the rim.

Further, the rim is an integrated structure; the first connection part, the support part, the left-eye contact part and the right-eye contact part are formed into an entirety.

Apparently, the rim may also be formed as a separated structure, including a left rim, and a right rim connected to the left rim through a second connection part.

The first connection part includes a left first connection part connected with the left rim, and a right first connection part connected with the right rim.

The support part includes a left support part connecting the left first connection part and the left-eye contact part, and a right support part connecting the right first connection part and the right-eye contact part.

The left-eye contact part, the left first connection part and the left support part are formed into an integrated structure.

The right-eye contact part, the right first connection part and the right support part are formed into an integrated structure.

The application will be further described below with reference to the accompanying drawings and detailed embodiments.

DETAILED DESCRIPTION OF THE EMBODIMENTS

In order to more fully understand the technical content of the present application, the technical proposal of the present application is further described and explained in conjunction with detailed embodiments below, but is not limited thereto.

Embodiment 1

Figure 1:
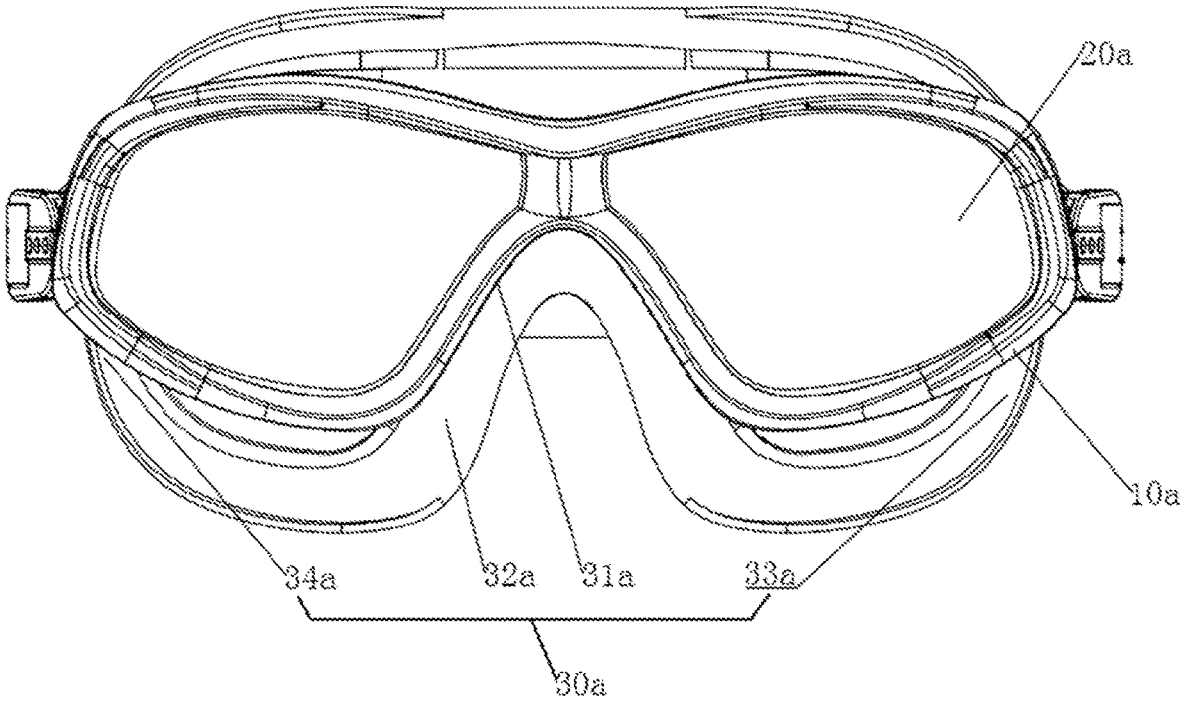
FIG. 1 is a structural view of the swimming goggles according to Embodiment 1 of the present application.
Figure 2:
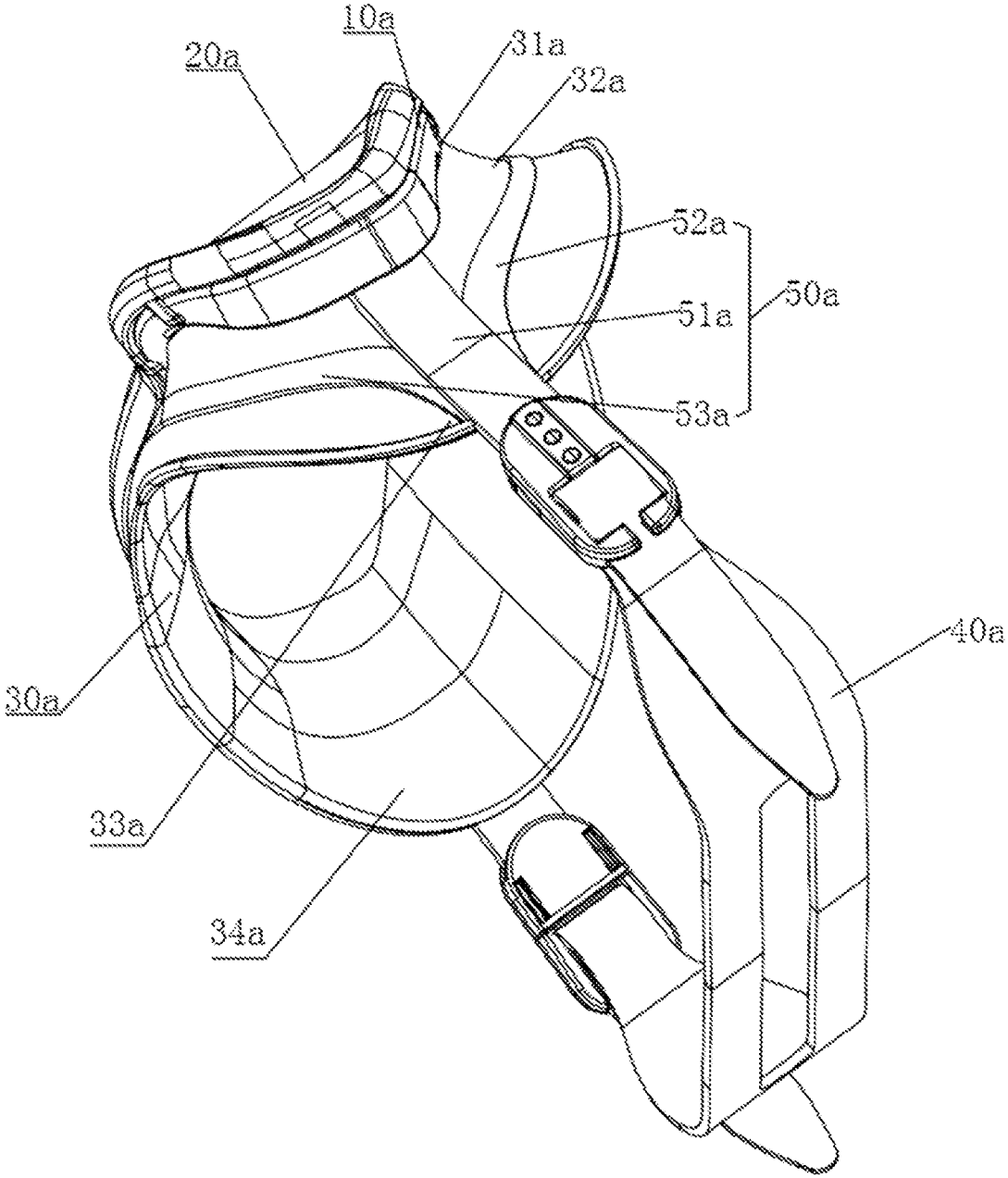
FIG. 2 is another structural view of the swimming goggles according to Embodiment 1 of the present application.
Figure 3:
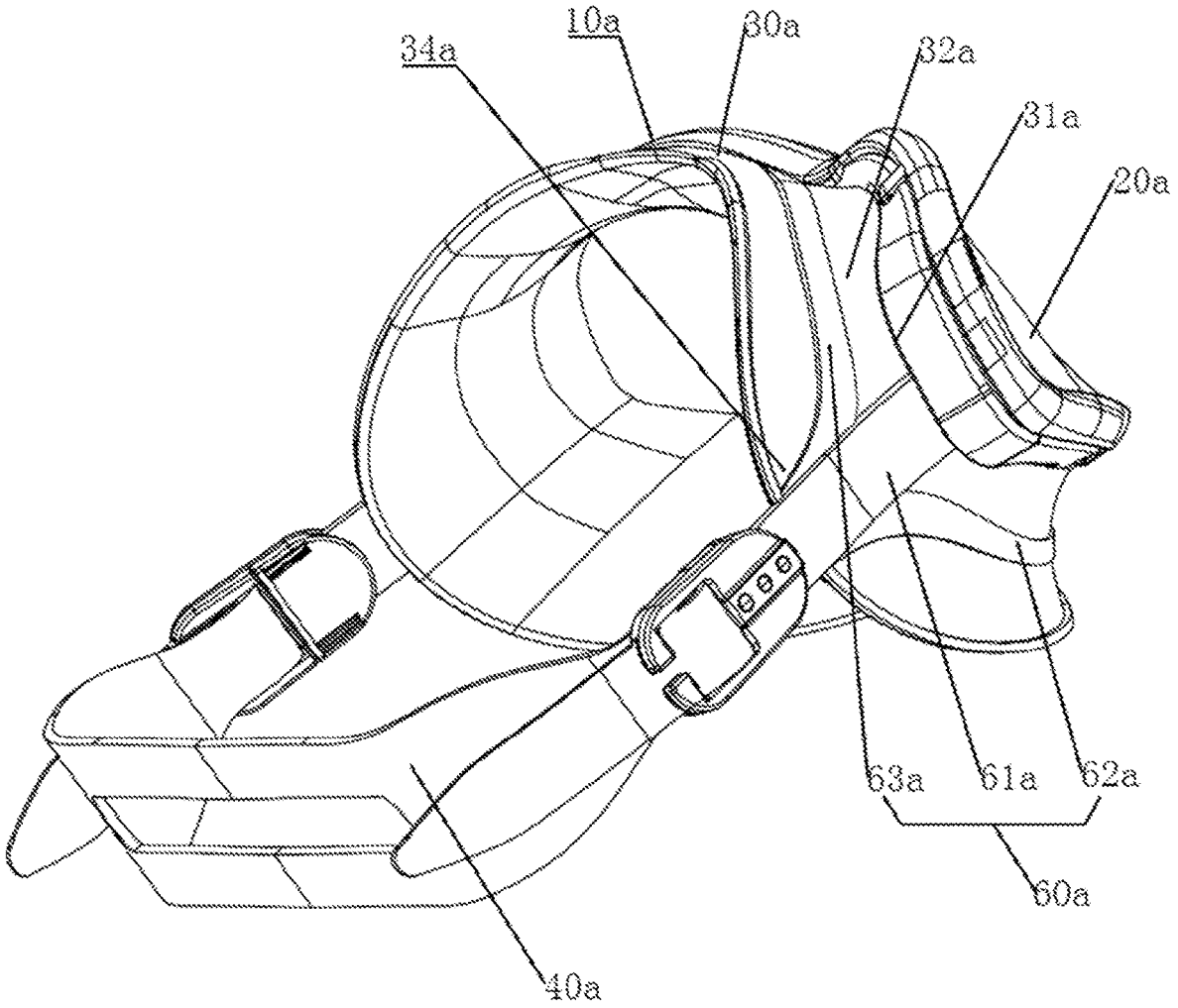
FIG. 3 is yet another structural view of the swimming goggles according to Embodiment 1 of the present application.

As shown in FIGS. 1-3, swimming goggles include a rim 10*a*, a lens 20*a* fixed on the rim 10*a* in a sealed manner, an elastic waterproofing ring 30*a* sealed on an inner side of the rim 10*a*, and a head band 40*a* connected to the elastic waterproofing ring 30*a* at both ends thereof.

The elastic waterproofing ring 30*a* includes a first connection part 31*a* connected to the rim 10*a*, a support part 32*a* connected to the first connection part 31*a*, a left-eye contact part 33*a* connected to the support part 32*a* and to be pressed against an outer contour of a left eye, and a right-eye contact part 34*a* connected to the support part 32*a* and to be pressed against an outer contour of a right eye. The first connection part 31*a*, the support part 32*a*, the left-eye contact part 33*a*, and the right-eye contact part 34*a* are formed in to an integrated structure by injection molding.

A left side of the head band 40*a* is connected to (formed into an entirety by injection molding with, or adhered to) a left side of an outer circumference of the left-eye contact part 33*a*, and a right side thereof is connected to (formed into an entirety by injection molding with, or adhered to) a right side of an outer circumference of the right-eye contact part 34*a*. Apparently, in other embodiments, the left side of the head band 40*a* may be connected to an outer wall of the left-eye contact part 33*a*, and the right side thereof may be connected to an outer wall of the right-eye contact part 34*a*.

Specifically, the rim 10*a* is an integrated structure; the first connection part 31*a*, the support part 32*a*, the left-eye contact part 33*a* and the right-eye contact part 34*a* are formed into an entirety.

Specifically, a first (or left) reinforcing rib 50*a* is provided on the left-eye contact part 33*a*, and a second (or right) reinforcing rib 60*a* is provided on the right-eye contact part 34*a*.

More specifically, the first (or left) reinforcing rib 50*a* consists of a first reinforcing rib A (or a first reinforcing rib) 51*a* extending towards the first connection part 31*a* from a position connected with the left side of the head band 40*a*, a first reinforcing rib B (or a second reinforcing rib) 52*a* provided along an upper edge of an outer circumference of the left-eye contact part 33*a*, and a first reinforcing rib C (or a third reinforcing rib) 53*a* provided along a lower edge of the outer circumference of the left-eye contact part 33*a*.

The second (or right) reinforcing rib 60*a* consists of a second reinforcing rib A (or a fourth reinforcing rib) 61*a* extending towards the first connection part 31*a* from a position connected with the right side of the head band 40*a*, a second reinforcing rib B (or a fifth reinforcing rib) 62*a* provided along an upper edge of an outer circumference of the right-eye contact part 34*a*, and a second reinforcing rib C (or a sixth reinforcing rib) 63*a* provided along a lower edge of the outer circumference of the right-eye contact part 34*a*.

In summary, in the above water goggles, since the left side of the head band is fixedly connected to the left side of the outer circumference of the left-eye contact part, and the right side thereof is fixedly connected to the right side of the outer circumference of the right-eye contact part, the left side of the head band may apply a pulling force towards the user's head on the left-eye contact part, and the right side of the head band may apply a pulling force towards the user's head on the right-eye contact part, such that the left-eye and right-eye contact parts are closely fitted to the orbit of the left and right eyes without detaching, thereby greatly improving the waterproofing effect.

In addition, the first reinforcing rib is provided on the left-eye contact part, and the second reinforcing rib is provided on the right-eye contact part. The first reinforcing rib consists of a first reinforcing rib A extending towards the first connection part from a position connected with the left side of the head band, a first reinforcing rib B provided along an upper edge of an outer circumference of the left-eye contact part, and a first reinforcing rib C provided along a lower edge of the outer circumference of the left-eye contact part. The second reinforcing rib consists of a second reinforcing rib A extending towards the first connection part from a position connected with the right side of the head band, a second reinforcing rib B provided along an upper edge of an outer circumference of the right-eye contact part, and a second reinforcing rib C provided along a lower edge of the outer circumference of the right-eye contact part.

The first reinforcing rib A allows the pulling force applied on the left-eye contact part by the left side of the head band to be evenly distributed to the inside of the left-eye contact part; The first reinforcing rib B allows the pulling force applied on the left-eye contact part by the left side of the head band to be evenly distributed to the upper edge of the outer circumference of the left-eye contact part; and the first reinforcing rib C allows the pulling force applied on the left-eye contact part by the left side of the head band to be evenly distributed to the lower edge of the outer circumference of the left-eye contact part.

The second reinforcing rib A allows the pulling force applied on the right-eye contact part by the right side of the head band to be evenly distributed to the inside of the right-eye contact part; The second reinforcing rib B allows the pulling force applied on the right-eye contact part by the right side of the head band to be evenly distributed to the upper edge of the outer circumference of the right-eye contact part; and the second reinforcing rib C allows the pulling force applied on the right-eye contact part by the right side of the head band to be evenly distributed to the lower edge of the outer circumference of the right-eye contact part.

Embodiment 2

Referring to FIGS. 1-3, the present embodiment also discloses swimming goggles, which have a structure basically the same as the swimming goggles in Embodiment 1, differing in that, in the swimming goggles of the present embodiment, only the first reinforcing rib A 51*a* is provided on the left-eye contact part 33*a*, and only the second reinforcing rib A 61*a* is provided on the right-eye contact part 34*a*.

Compared with Embodiment 1, the present embodiment may also solve the same technical problem. Since the first reinforcing rib B, the first reinforcing rib C, the second reinforcing rib B, and the second reinforcing rib C are not provided, the swimming goggles of the present embodiment are less effective in distributing the pulling force on the elastic waterproof ring applied by the head band 40 than those in Embodiment 1.

Embodiment 3

Referring to FIGS. 1-3, the present embodiment also discloses swimming goggles, which have a structure basically the same as the swimming goggles in Embodiment 1, differing in that, in the swimming goggles of the present embodiment, only a first reinforcing rib B 52*a* along the upper edge, or a first reinforcing rib C 53*a* along the lower edge, of the outer circumference of the left-eye contact part 33*a* is provided; and only a second reinforcing rib B 62*a* along an upper edge, or a second reinforcing rib C 63*a* along a lower edge, of the outer circumference of the right-eye contact part 34*a* is provided.

Compared with Embodiment 1, the present embodiment may also solve the same technical problem. Since the first reinforcing rib and the second reinforcing rib provided are less than those in Embodiment 1, the swimming goggles of the present embodiment are less effective in distributing the pulling force on the elastic waterproof ring 30*a* applied by the head band 40*a* than those in Embodiment 1.

Embodiment 4

Figure 4:
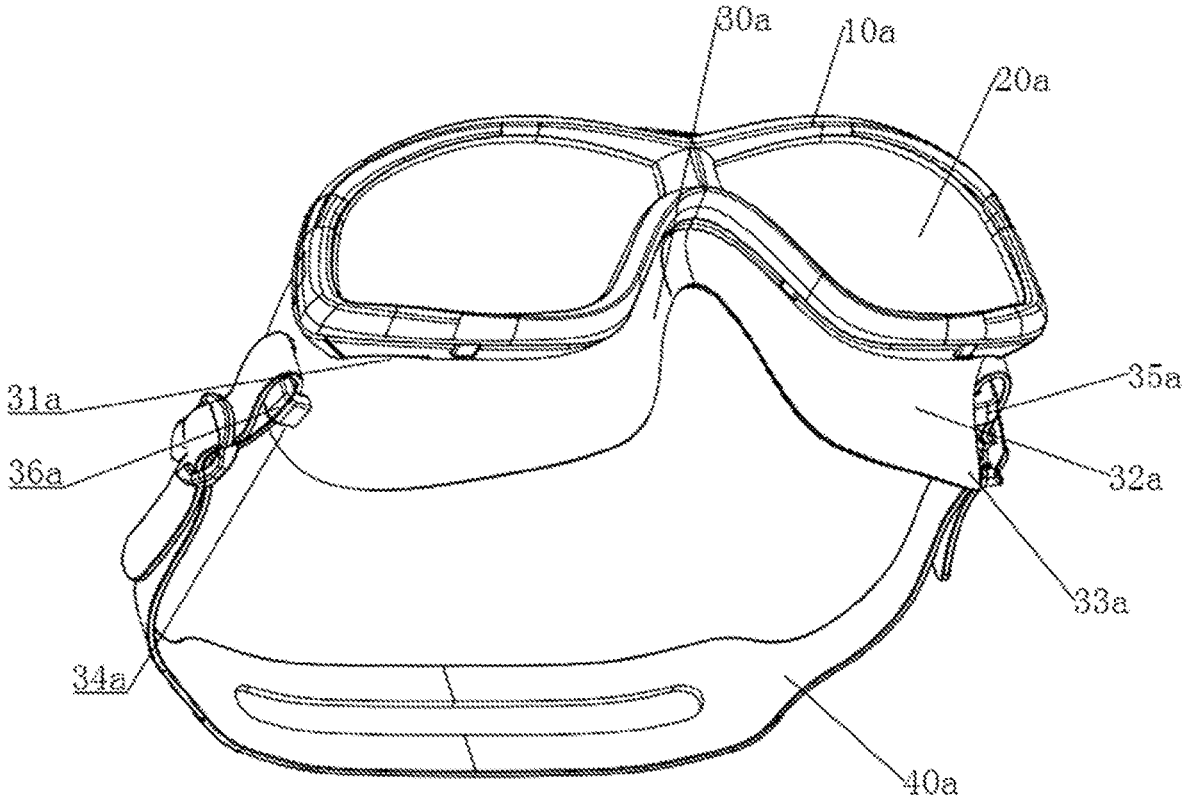
FIG. 4 is a structural view of the swimming goggles according to Embodiment 4 of the present application.

As shown in FIG. 4, the present embodiment also discloses swimming goggles, which have a structure basically the same as the swimming goggles in Embodiment 1, differing in that, in the swimming goggles of the present embodiment, a left connection member 35*a* (e.g. a buckle) is provided on an outer wall of the left-eye contact part 33*a*, and a right connection member 36*a* (e.g. a buckle) is provided on an outer wall of the right-eye contact part 34*a*. The left side of the head band 40*a* is fixedly connected to the left connection member 35*a*, and the right side thereof is fixedly connected to the right connection member 36*a*.

Compared with Embodiment 1, the present embodiment provides another connecting method between the two ends of the head band and the left-eye and right-eye contact part.

Embodiment 5

Figure 5:
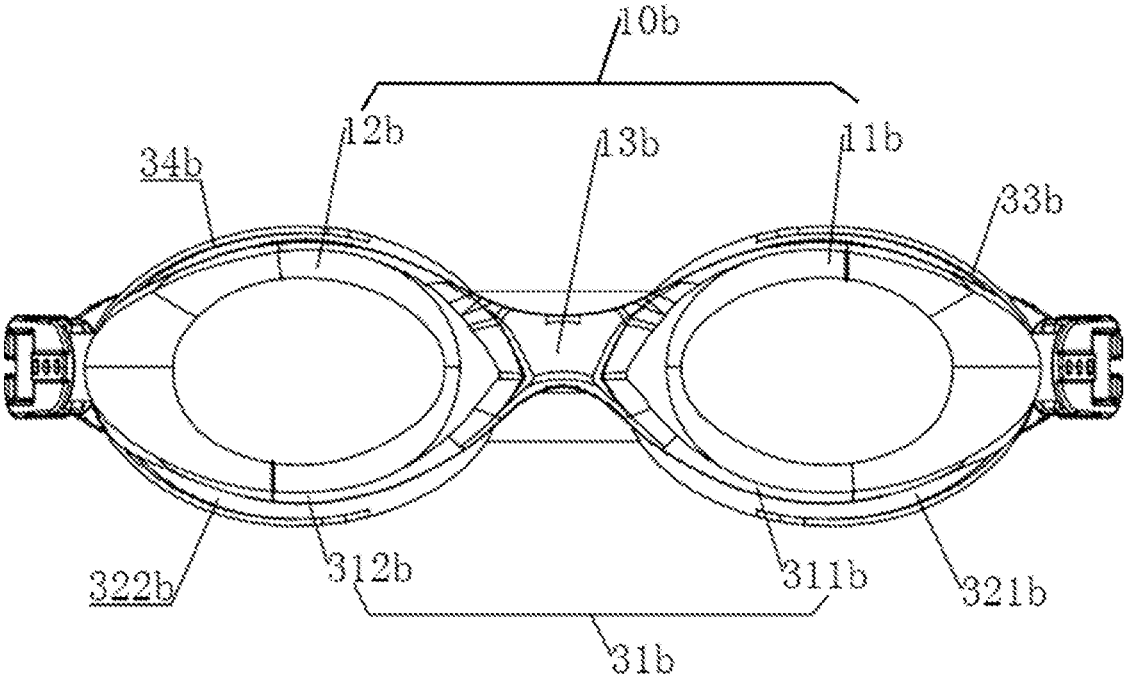
FIG. 5 is a structural view of the swimming goggles according to Embodiment 5 of the present application.
Figure 6:
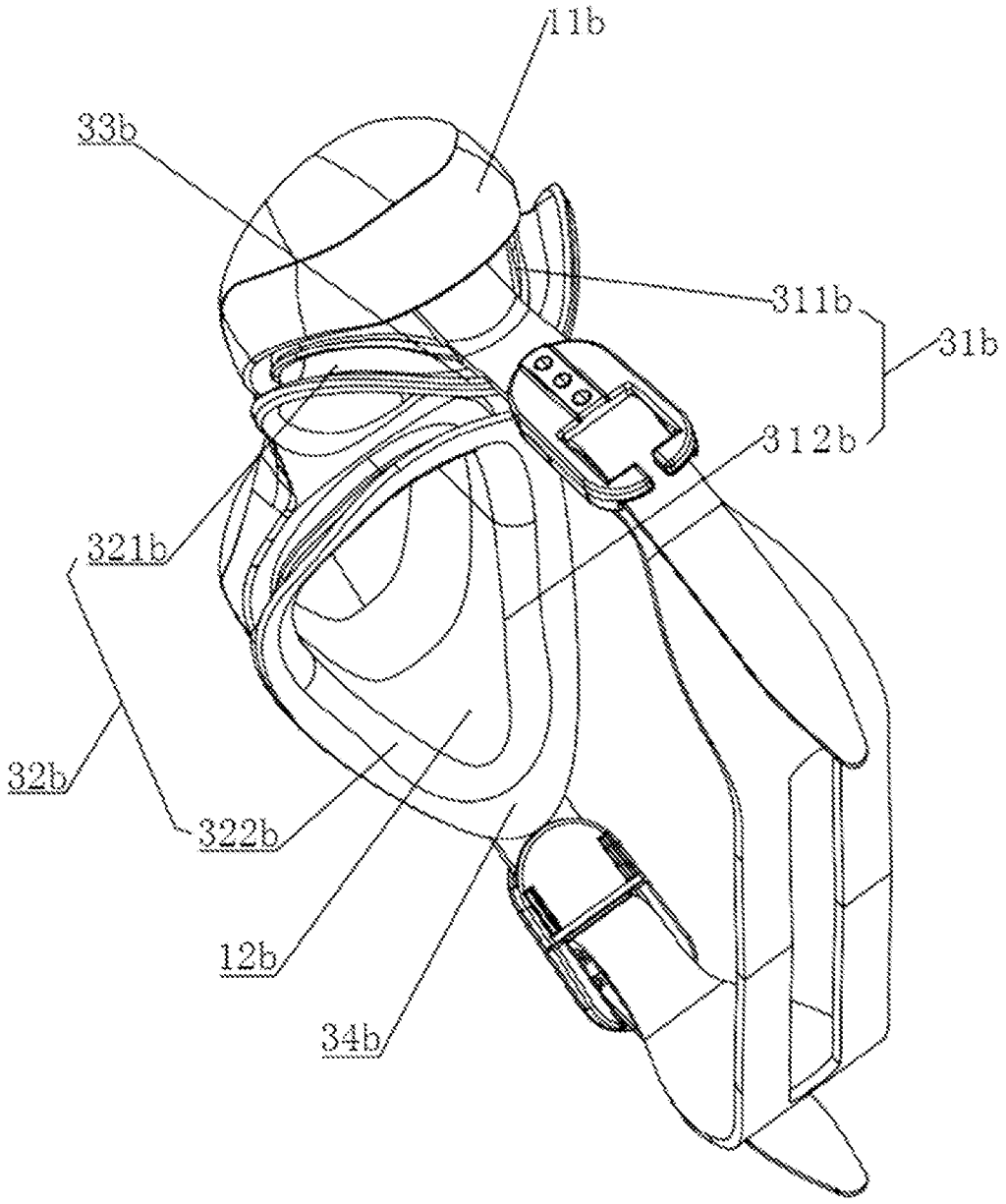
FIG. 6 is another structural view of the swimming goggles according to Embodiment 5 of the present application.
Figure 7:
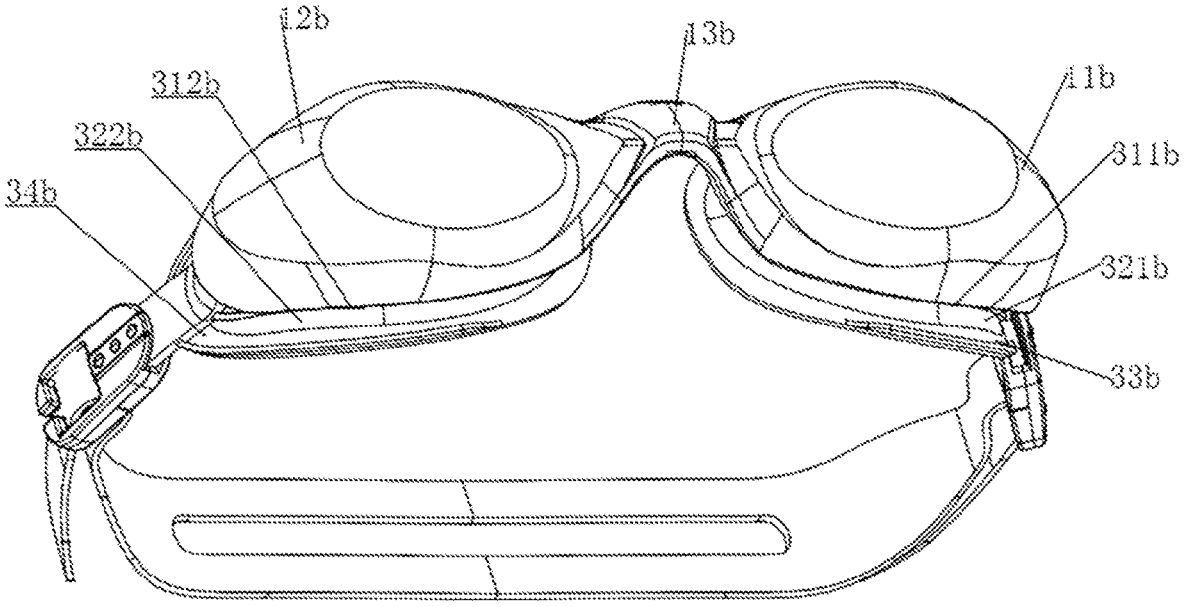
FIG. 7 is yet another structural view of the swimming goggles according to Embodiment 5 of the present application.

As shown in FIGS. 5-7, the present embodiment also discloses swimming goggles, which have a structure basically the same as the swimming goggles in Embodiment 1, differing in that, in the swimming goggles of the present embodiment, the rim 10*b* is formed as a separated structure, including a left rim 11*b*, and a right rim 12*b* connected to the left rim 11*b* through a second connection part 13*b*.

The first connection part 31*b* includes a left first connection part 311*b* connected with the left rim 11*b*, and a right first connection part 312*b* connected with the right rim 12*b*.

The support part 32*b* includes a left support part 321*b* connecting the left first connection part 311*b* and the left-eye contact part 33*b*, and a right support part 322*b* connecting the right first connection part 312*b* and the right-eye contact part 34*b*.

The left-eye contact part 33*b*, the left first connection part 311*b* and the left support part 321*b* are formed into an integrated structure.

The right-eye contact part 34*b*, the right first connection part 312*b* and the right support part 322*b* are formed into an integrated structure.

Embodiment 6

Figure 8:
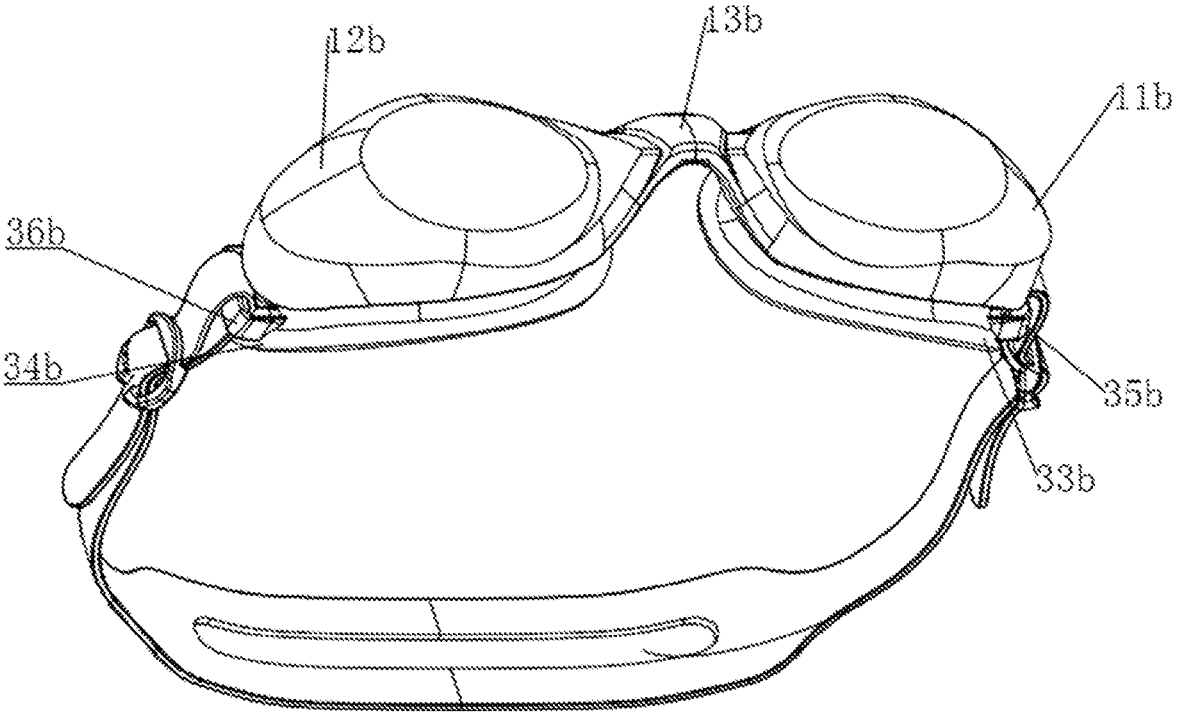
FIG. 8 is a structural view of the swimming goggles according to Embodiment 6 of the present application.

As shown in FIG. 8, the present embodiment also discloses swimming goggles, which have a structure basically the same as the swimming goggles in Embodiment 5, differing in that, in the swimming goggles of the present embodiment, a left connection member 35*b* (e.g. a buckle) is provided on an outer wall of the left-eye contact part 33*b*, and a right connection member 36*b* (e.g. a buckle) is provided on an outer wall of the right-eye contact part 34*b*. The left side of the head band 40*b* is fixedly connected to the left connection member 35*b*, and the right side thereof is fixedly connected to the right connection member 36*b*.

Compared with Embodiment 5, the present embodiment provides another connecting method between the two ends of the head band and the left-eye and right-eye contact part.

Embodiment 7

The present embodiment also discloses swimming goggles, which have a structure basically the same as the swimming goggles in Embodiment 5, differing in that, the lens and rim of the swimming goggles of the present embodiment are formed into an integrated structure.

Embodiment 8

Figure 9:
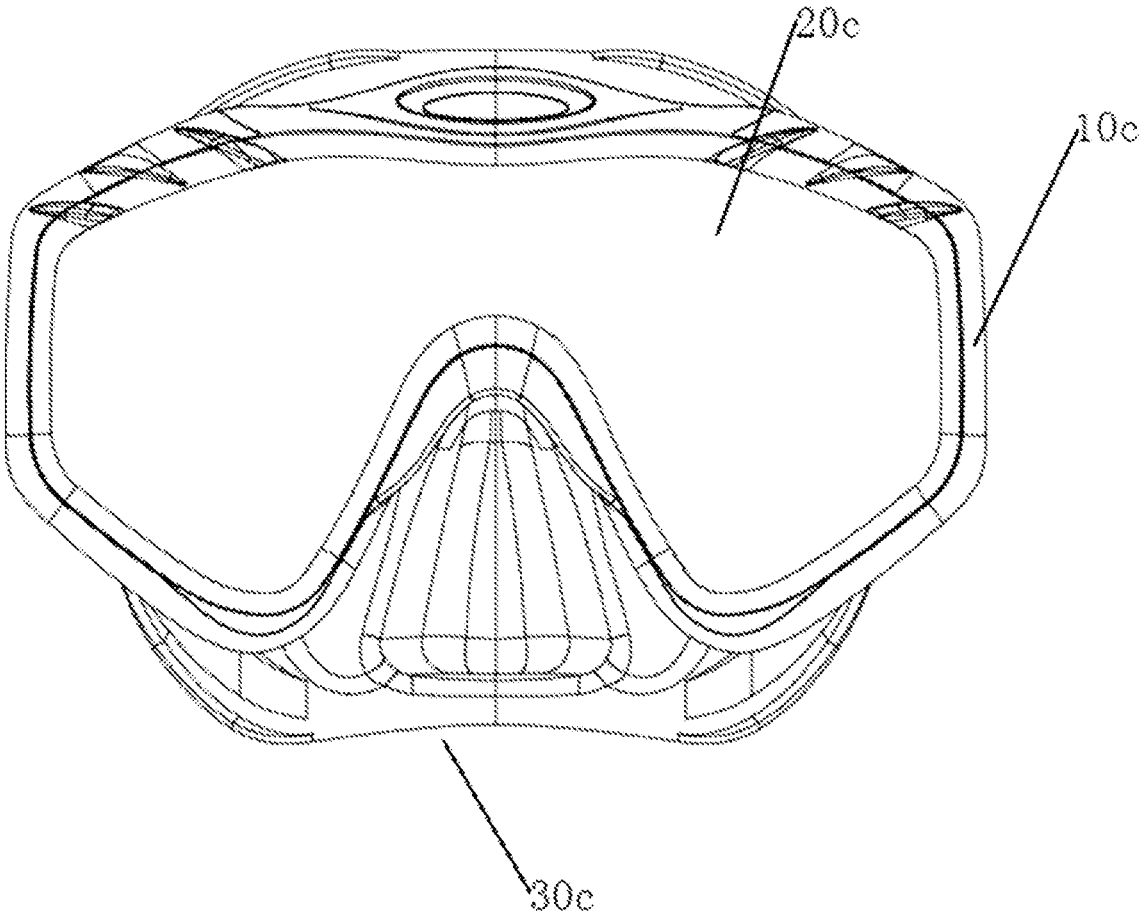
FIG. 9 is a structural view of the diving goggles according to Embodiment 8 of the present application.
Figure 10:
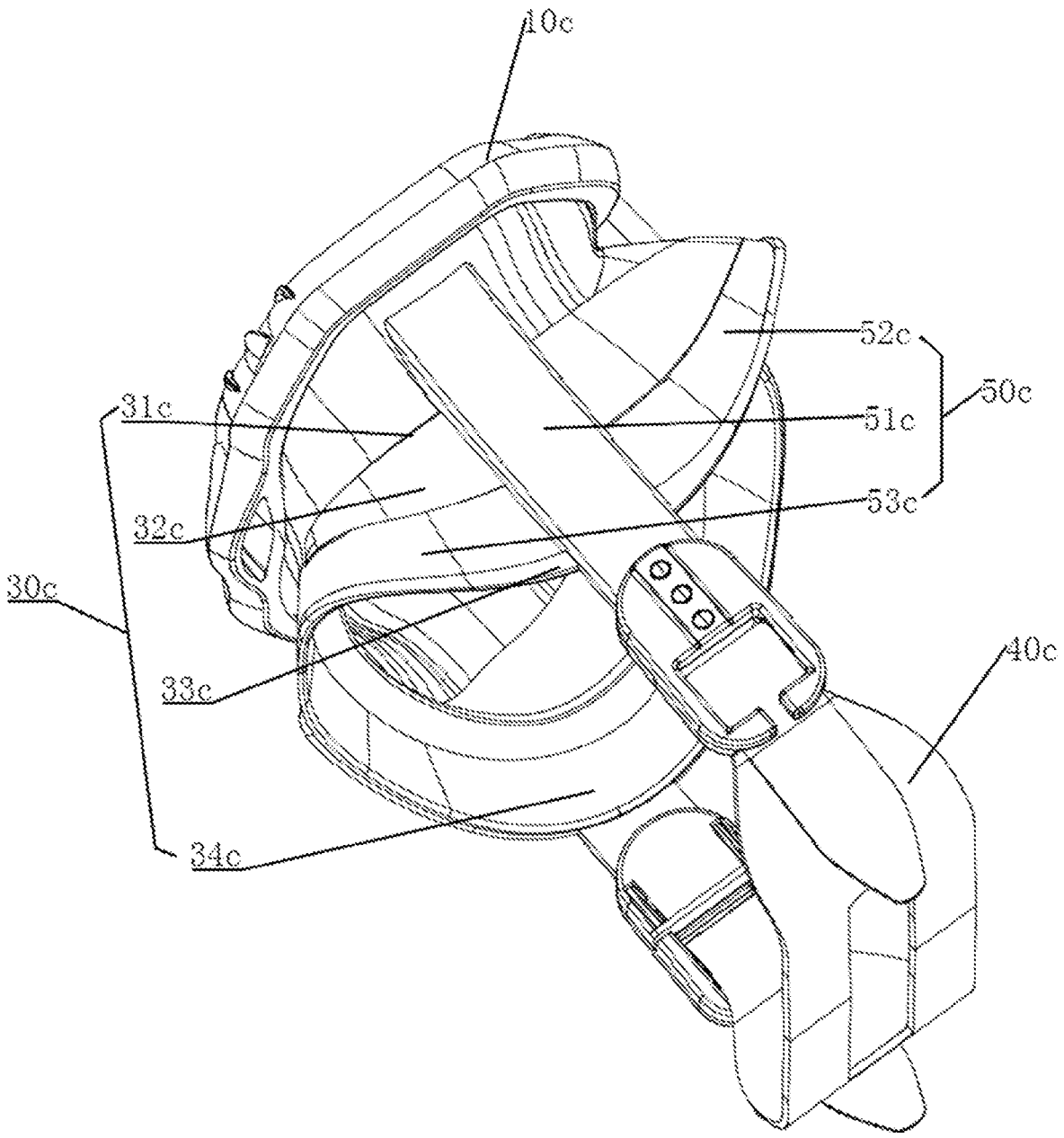
FIG. 10 is another structural view of the diving goggles according to Embodiment 8 of the present application.
Figure 11:
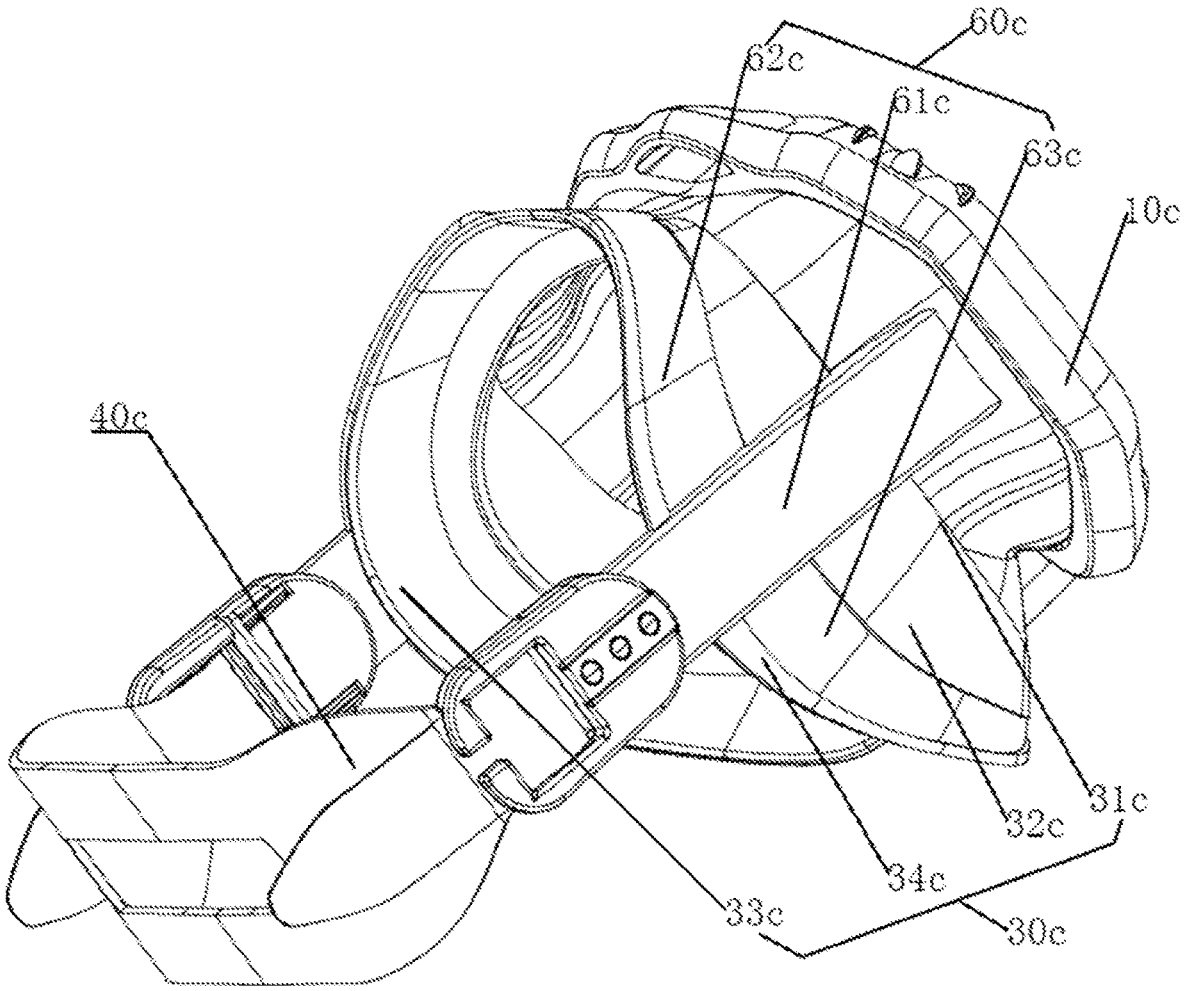
FIG. 11 is yet another structural view of the diving goggles according to Embodiment 8 of the present application.

As shown in FIGS. 9-11, the present embodiment discloses diving goggles, which include a rim 10*c*, a lens 20*c* fixed on the rim 10*c* in a sealed manner, an elastic waterproofing ring 30*c* sealed on an inner side of the rim 10*c*, and a head band 40*c* connected to the elastic waterproofing ring 30*c* at both ends thereof.

The elastic waterproofing ring 30*c* includes a first connection part 31*c* connected to the rim 10*c*, a support part 32*c* connected to the first connection part 31*c*, a left-eye contact part 33*c* connected to the support part 32*c* and to be pressed against an outer contour of a left eye, and a right-eye contact part 34*c* connected to the support part 32*c* and to be pressed against an outer contour of a right eye. The first connection part 31*c*, the support part 32*c*, the left-eye contact part 33*c*, and the right-eye contact part 34*c* are formed in to an integrated structure by injection molding.

A left side of the head band 40*c* is connected to (formed into an entirety by injection molding with, or adhered to) a left side of an outer circumference of the left-eye contact part 33*c*, and a right side thereof is connected to (formed into an entirety by injection molding with, or adhered to) a right side of an outer circumference of the right-eye contact part 34*c*. Apparently, in other embodiments, the left side of the head band 40*c* may be connected to an outer wall of the left-eye contact part 33*c*, and the right side thereof may be connected to an outer wall of the right-eye contact part 34*c*.

Specifically, the rim 10*c* has an integrated structure; the first connection part 31*c*, the support part 32*c*, the left-eye contact part 33*c* and the right-eye contact part 34*c* are formed into an entirety.

Specifically, a first reinforcing rib 50*c* is provided on the left-eye contact part 33*c*, and a second reinforcing rib 60*c* is provided on the right-eye contact part 34*c*.

More specifically, the first reinforcing rib 50*c* consists of a first reinforcing rib A 51*c* extending towards the first connection part 31*c* from a position connected with the left side of the head band 40*c*, a first reinforcing rib B 52*c* provided along an upper edge of an outer circumference of the left-eye contact part 33*c*, and a first reinforcing rib C 53*c* provided along a lower edge of the outer circumference of the left-eye contact part 33*c*.

The second reinforcing rib 60*c* consists of a second reinforcing rib A 61*c* extending towards the first connection part 31*c* from a position connected with the right side of the head band 40*c*, a second reinforcing rib B 62*c* provided along an upper edge of an outer circumference of the right-eye contact part 34*c*, and a second reinforcing rib C 63*c* provided along a lower edge of the outer circumference of the right-eye contact part 34*c*.

In summary, in the above water goggles, since the left side of the head band is fixedly connected to the left side of the outer circumference of the left-eye contact part, and the right side thereof is fixedly connected to the right side of the outer circumference of the right-eye contact part, the left side of the head band may apply a pulling force towards the user's head on the left-eye contact part, and the right side of the head band may apply a pulling force towards the user's head on the right-eye contact part, such that the left-eye and right-eye contact parts are closely fitted to the orbit of the left and right eyes without detaching, thereby greatly improving the waterproofing effect.

In addition, the first reinforcing rib is provided on the left-eye contact part, and the second reinforcing rib is provided on the right-eye contact part. The first reinforcing rib consists of a first reinforcing rib A extending towards the first connection part from a position connected with the left side of the head band, a first reinforcing rib B provided along an upper edge of an outer circumference of the left-eye contact part, and a first reinforcing rib C provided along a lower edge of the outer circumference of the left-eye contact part. The second reinforcing rib consists of a second reinforcing rib A extending towards the first connection part from a position connected with the right side of the head band, a second reinforcing rib B provided along an upper edge of an outer circumference of the right-eye contact part, and a second reinforcing rib C provided along a lower edge of the outer circumference of the right-eye contact part.

The first reinforcing rib A allows the pulling force applied on the left-eye contact part by the left side of the head band to be evenly distributed to the inside of the left-eye contact part; The first reinforcing rib B allows the pulling force applied on the left-eye contact part by the left side of the head band to be evenly distributed to the upper edge of the outer circumference of the left-eye contact part; and the first reinforcing rib C allows the pulling force applied on the left-eye contact part by the left side of the head band to be evenly distributed to the lower edge of the outer circumference of the left-eye contact part.

The second reinforcing rib A allows the pulling force applied on the right-eye contact part by the right side of the head band to be evenly distributed to the inside of the right-eye contact part; The second reinforcing rib B allows the pulling force applied on the right-eye contact part by the right side of the head band to be evenly distributed to the upper edge of the outer circumference of the right-eye contact part; and the second reinforcing rib C allows the pulling force applied on the right-eye contact part by the right side of the head band to be evenly distributed to the lower edge of the outer circumference of the right-eye contact part.

Embodiment 9

Referring to FIGS. 9-11, the present embodiment also discloses diving goggles, which have a structure basically the same as the diving goggles in Embodiment 8, differing in that, in the diving goggles of the present embodiment, only the first reinforcing rib A 51*c* is provided on the left-eye contact part 33*c*, and only the second reinforcing rib A 61*c* is provided on the right-eye contact part 34*c*.

Compared with Embodiment 8, the present embodiment may also solve the same technical problem. Since the first reinforcing rib B, the first reinforcing rib C, the second reinforcing rib B, and the second reinforcing rib C are not provided, the diving goggles of the present embodiment are less effective in distributing the pulling force on the elastic waterproof ring applied by the head band 40 than those in Embodiment 8.

Embodiment 10

Referring to FIGS. 9-11, the present embodiment also discloses diving goggles, which have a structure basically the same as the diving goggles in Embodiment 8, differing in that, in the diving goggles of the present embodiment, only a first reinforcing rib B 52*a* along the upper edge, or a first reinforcing rib C 53*a* along the lower edge, of the outer circumference of the left-eye contact part 33*a* is provided; and only a second reinforcing rib B 62*a* along an upper edge, or a second reinforcing rib C 63*a* along a lower edge, of the outer circumference of the right-eye contact part 34*a* is provided.

Compared with Embodiment 8, the present embodiment may also solve the same technical problem. Since the first reinforcing rib and the second reinforcing rib provided are less than those in Embodiment 8, the diving goggles of the present embodiment are less effective in distributing the pulling force on the elastic waterproof ring 30*c* applied by the head band 40*c* than those in Embodiment 8.

Embodiment 11

Figure 12:
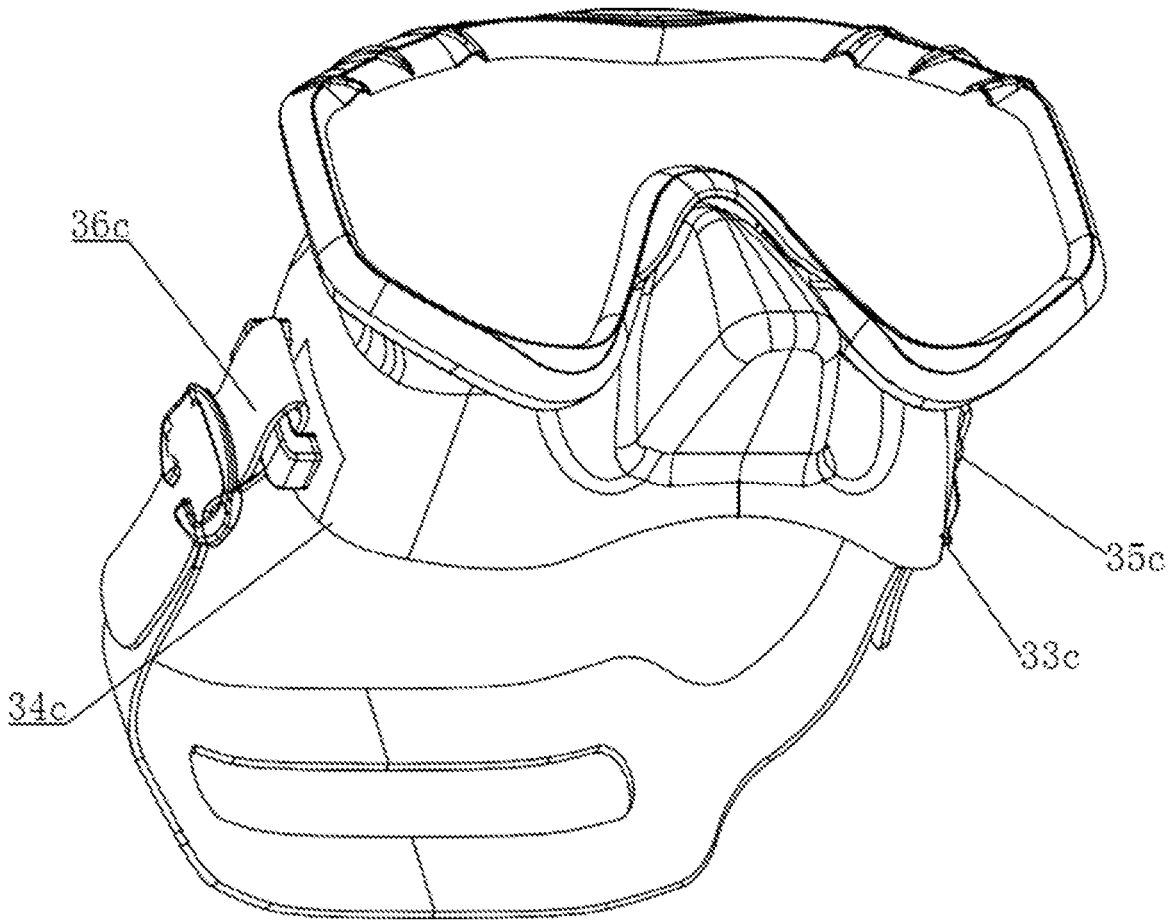
FIG. 12 is a structural view of the diving goggles according to Embodiment 11 of the present application.

As shown in FIG. 12, the present embodiment also discloses diving goggles, which have a structure basically the same as the diving goggles in Embodiment 8, differing in that, in the diving goggles of the present embodiment, a left connection member 35*c* (e.g. a buckle) is provided on an outer wall of the left-eye contact part 33*c*, and a right connection member 36*c* (e.g. a buckle) is provided on an outer wall of the right-eye contact part 34*c*. The left side of the head band 40*c* is fixedly connected to the left connection member 35*c*, and the right side thereof is fixedly connected to the right connection member 36*c*.

Compared with Embodiment 8, the present embodiment provides another connecting method between the two ends of the head band and the left-eye and right-eye contact part.

The above are merely examples to further illustrate the technical content of this application for easier understanding of readers, but are not intended to limit the implementation of this application. Any technical extension or re-creation made according to this application falls within the scope of protection of this application. The scope of protection of this application is defined by the appended claims.

The invention claimed is:

1. Water goggles, comprising: a rim, a lens fixed on the rim in a sealed manner, an elastic waterproofing ring sealed on an inner side of the rim, and a head band connected to the elastic waterproofing ring at both ends of the head band, wherein the elastic waterproofing ring comprises a first connection part connected to the rim, a support part connected to the first connection part, a left-eye contact part connected to the support part and to be pressed against an outer contour of a left eye, and a right-eye contact part connected to the support part and to be pressed against an outer contour of a right eye, a left side of the head band is connected to a left side of an outer periphery of the left-eye contact part, and a right side of the head band is connected to a right side of an outer periphery of the right-eye contact part, wherein the left-eye contact part is provided with a left reinforcing rib, and the right-eye contact part is provided with a right reinforcing rib, wherein the left reinforcing rib comprises a first reinforcing rib extending to the first connection part from a position connected with the left side of the head band, a second reinforcing rib provided along an upper edge of an outer circumference of the left-eye contact part, and a third reinforcing rib provided along a lower edge of the outer circumference of the left-eye contact part, and wherein the right reinforcing rib comprises a fourth reinforcing rib extending to the first connection part from a position connected with the right side of the head band, a fifth reinforcing rib provided along an upper edge of an outer circumference of the right-eye contact part, and a sixth reinforcing rib provided along a lower edge of the outer circumference of the right-eye contact part.

2. The water goggles according to claim 1, wherein the left side of the head band is formed into an integrated structure with the left-eye contact part, and the right side of the head band is formed into an integrated structure with the right-eye contact part.

3. The water goggles according to claim 1, wherein a left end portion of the head band is smoothly connected to a left side of an outer circumference of the left-eye contact part, and a right end portion of the head band is smoothly connected to a right side of an outer circumference of the right-eye contact part.

4. The water goggles according to claim 3, wherein the left side of the head band is fitted to the outer wall of the left-eye contact part, and the right side of the head band is fitted to the outer wall of the right-eye contact part;

or, the left end portion of the head band is connected to the outer wall of the left-eye contact part, and the right end portion of the head band is fitted to the outer wall of the right-eye contact part.

5. The water goggles according to claim 1, wherein the lens and the rim form an integrated structure.

6. The water goggles according to claim 1, wherein the rim is formed as a separated structure, comprising a left rim, and a right rim connected to the left rim through a second connection part;

wherein the first connection part comprises a left first connection part connected with the left rim, and a right first connection part connected with the right rim;

the support part comprises a left support part connecting the left first connection part and the left-eye contact part, and a right support part connecting the right first connection part and the right-eye contact part;

the left-eye contact part, the left first connection part and the left support part are formed into an integrated structure; and the right-eye contact part, the right first connection part and the right support part are formed into an integrated structure.

* * * * *